United States Patent [19]

Ballinger

[11] 4,300,217

[45] Nov. 10, 1981

[54] ACOUSTIC TRANSDUCER HOUSING

[75] Inventor: Dale O. Ballinger, Denver, Colo.

[73] Assignee: Honeywell Inc., Minneapolis, Minn.

[21] Appl. No.: 173,859

[22] Filed: Jul. 30, 1980

[51] Int. Cl.[3] ..... H04R 1/02

[52] U.S. Cl. ..... 367/140; 73/633; 181/139; 181/198; 367/104; 367/151; 367/173

[58] Field of Search ..... 367/104, 140, 151, 165, 367/173, 87, 188; 181/0.5, 143, 175, 198, 139, 140, 142, 155, 191; 73/627, 633

[56] References Cited

U.S. PATENT DOCUMENTS 3,783,967 1/1974 Apgar ..... 181/142

3,886,490 5/1975 Green ..... 367/104 X

*Primary Examiner*—Richard A. Farley

*Attorney, Agent, or Firm*—Lockwood D. Burton; Mitchell J. Halista

[57] ABSTRACT

A housing for an acoustic transducer includes means for dispersing internal reflections within the housing to minimize the incidence of such internally reflected acoustic pulses on the transducer itself, thereby avoiding the generation of spurious electrical signals for transmission to the translating circuitry.

4 Claims, 2 Drawing Figures

(STATE OF THE ART)

ACOUSTIC TRANSDUCER HOUSING

BACKGROUND OF THE INVENTION

The present invention relates to electroacoustic transducers. More particularly, it relates to housing means for electroacoustic transducers.

In the art of medical diagnostics, one form of non-invasive examination of the internal organs of a body under examination involves the use of ultrasonic transducers. These transducers are frequently mounted within a housing filled with an inert liquid and arranged to oscillate in an angularly scanning motion. The housing is generally relatively opaque to the ultrasonic pulses generated by the transducer, with the exception of a relatively transparent window or diaphragm in the operating end of the housing structure. The transducer is positioned and oscillated to direct the acoustic pulses through the diaphragm or window, into the body under examination. The acoustic pulses transmitted into that body are then reflected back toward the transducer at interfaces of tissues within the body, to produce electrical pulses which may be translated into an image of the interior of the body being examined. It has been found, however, that spurious signals have been returned to the transducer as internal reflections from the interior walls of the housing member. These spurious reflections come about because the diaphragm or window is not perfectly transparent to the acoustic pulses and a part of the energy is internally reflected. The spurious reflections will, of course, provide a measure of pulse information which the sensing and translating system cannot differentiate from genuine signals reflected from the interior of the body under examination.

SUMMARY OF THE INVENTION

It is, accordingly, an object of the present invention to provide an improved housing structure for an acoustic transducer.

It is another object of the present invention to provide an improved housing structure as set forth and which obviates the present shortcomings of the transducer housing structure.

In accomplishing these and other objects, there has been provided, in accordance with the present invention, a housing for an acoustic transducer which includes means for dispersing internal reflections within the housing to minimize the incidence of such internally reflected acoustic pulses on the transducer itself, thereby avoiding the generation of spurious electrical signals for transmission to the translating circuitry.

BRIEF DESCRIPTION OF THE DRAWINGS

A better understanding of the present invention may be had from the following detailed description when read in the light of the accompanying drawings in which.

DETAILED DESCRIPTION

Figure 1:
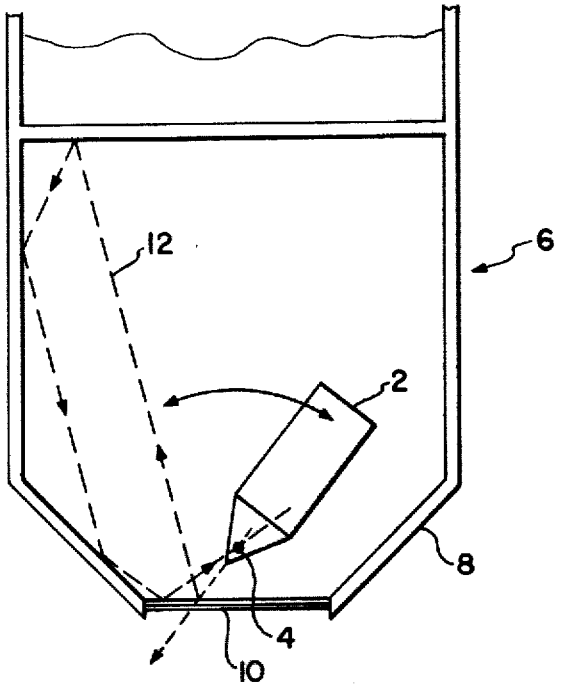
FIG. 1 is a cross-sectional view of a portion of a state of the art transducer housing structure.

Referring now to the drawings in more detail, there is shown in FIG. 1 a transducer housing which represents the state of the art structure. A transducer 2 is mounted for oscillatory motion about a pivot point 4 within the body of a housing structure 6. Suitable mechanism for driving the transducer through such oscillatory movement is provided although not shown in the present drawings because such mechanism is not a part of the present invention. The housing member 6 is generally cylindrical in shape having the operating end thereof in the form of a truncated cone. The conical end section 8 provides a measure of definition of the working end of the housing member permitting more accurate positioning of the structure adjacent a body to be examined. The body of the housing 6 including the conical end portion 8 is preferably made of a tough plastic material such as polycarbonate. The truncated end of the conical portion contains an acoustically transparent window 10. The window 10 is preferably in the form of a diaphragm made of an acoustically transparent material such as rubber, silicone, polyethylene, latex, or the like.

As the transducer 2 is excited to produce acoustic pulses, these pulses are directed through the window 10 and into the body under examination. Because, however, the window 10 is not perfectly transparent, a portion of the energy of the acoustic pulses is reflected from the inner surface of the window 10, internally reflected by the end walls and side walls of the housing 6 and from the smooth conical inner surface 8 to the diaphragm 10 than back into the transducer 2 as a reflected pulse, as represented by the dotted arrow 12. This causes a spurious response signal in the transducer and the associated electronic circuitry used for translating the reflected pulses.

Figure 2:
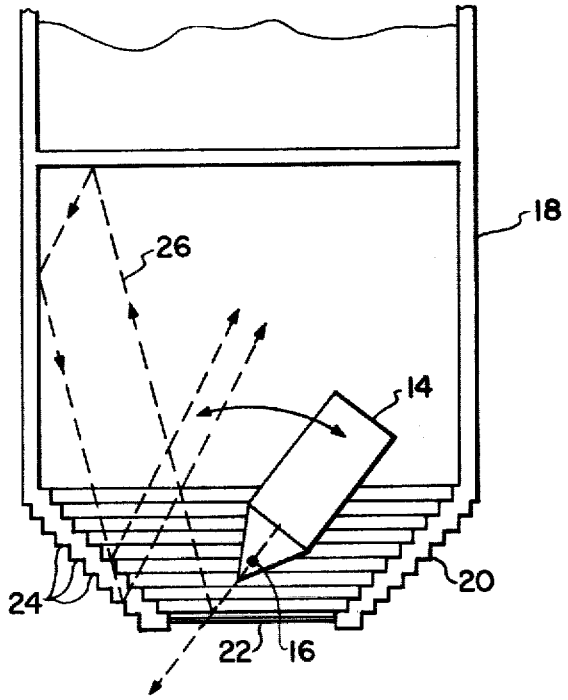
FIG. 2 is a cross-sectional view of a portion of a transducer housing structure embodying the present invention.

In FIG. 2, there is shown a housing structure constructed in accordance with the present invention which obviates or greatly reduces the probability of an internally reflected pulse being returned to the transducer. The structure as shown in FIG. 2 includes a transducer 14 mounted for oscillatory movement about a pivot point 16 inside of a housing member 18. As in FIG. 1, the housing member is generally cylindrical in shape and has an end or operating portion which is generally conical with a truncated peak or end. The truncated end of the conical portion 20 includes a window 22. The generally conical portion 20, instead of being a smooth truncated cone, as in FIG. 1, is formed of a series of progressively smaller diameter annuli, arranged in progressive orthogonal steps from the larger diameter of the housing 18 to the smaller diameter of the window 22. The stepped annular surface 24 are formed on the interior as well as the exterior of the generally conical portion 20. In a structure constructed in accordance with the present invention the body portion of the housing was approximately 1.75 inches in diameter, the window end of the conical portion was approximately 1 inch in diameter, and the individual steps of the annuli were approximately $0.030 \times 0.030$ inches. As illustrated by the dotted arrow 26 in FIG. 2, the stepped surfaces 24 present a much sharper angle of incidence for the reflected sonic pulses.

When the transducer 14 is driven to produce the acoustic pulses, again these pulses are directed through the window 22 and into the body under examination. Here, too, the window is not a perfect transparency, therefore a portion of the acoustic energy is reflected from the inner surface of the window or diaphragm 22 toward the rear wall of the housing structure, from the side walls 18, to the stepped conical portion 20. The signals as may be seen are reflected at a sharper angle both from the inner and outer surfaces of the steps 24 and back into the cavity of the housing member. The cavity is filled with an inert but acoustically damping fluid and after these reflections are reflected away from the transducer, the energy is effectively dissipated before it produces such spurious signals in the transducer itself.

Thus, there has been provided, an improved transducer housing structure which reduces the internally reflected signals. Those internally reflected signals would tend to cause misinformation to be applied from the transducer 14 to the translating circuitry.

The embodiments of the invention in which an exclusive property or privilege is claimed are defined as follows:

1. A housing structure for an electroacoustic transducer comprising a main body portion having a first cross-sectional dimension:

a generally truncated conical end portion having a larger end terminating at one end of said main body portion and a smaller end comprising an operating end of said structure, and an acoustically transparent window secured in said operating end, said conical end portion of said housing structure being formed of a plurality of stepped annuli, whereby to provide sharp angles of incidence to internally reflected acoustic pulses to minimize spurious signals in said transducer.

2. A housing structure as set forth in claim 1 wherein said housing is filled with an acoustic damping fluid.

3. A housing structure as set forth in claim 1 wherein said truncated conical end portion is provided with said stepped annuli both internally and externally of said conical portion.

4. A housing structure as set forth in claim 3 wherein the individual steps of said stepped annuli are substantially 0.030 inches on both sides.

* * * * *